United States Patent [19]

Smith

[11] 3,996,680

[45] Dec. 14, 1976

[54] DISPLAY ELEMENT

[75] Inventor: Charles Norman Smith, Ontario Canada

[73] Assignee: Ferranti-Packard Limited, Toronto, Canada

[22] Filed: Aug. 18, 1975

[21] Appl. No.: 605,303

[52] U.S. Cl. ..... 40/28 C; 40/52 R

[51] Int. Cl.[2] ..... G09F 11/00

[58] Field of Search ..... 40/39, 28 C, 52, 139; 356/216

[56] References Cited

UNITED STATES PATENTS

| | | | |
|---|---|---|---|
| 1,191,023 | 7/1916 | Naylor | 40/28 C |
| 2,728,154 | 12/1955 | Ross et al. | 40/39 |
| 3,085,545 | 4/1963 | Ore | 40/39 X |
| 3,745,563 | 7/1973 | Jones et al. | 40/28 C X |
| 3,757,730 | 9/1973 | Douglas | 40/39 X |

*Primary Examiner*—Hugh R. Chamblee
*Assistant Examiner*—Wenceslao J. Contreras

[57] ABSTRACT

A magnetically operated display element comprises a disc of substantially non-magnetic material, provided on opposite sides with ears extending transversely in the same direction relative to the disc, said ears being designed to allow the pivotal mounting of said disc on supporting means. The disc is contrastingly colored on opposite surfaces and shaped so that concavities are provided as viewed on one of said surfaces, such concavities being on opposite sides of and defining on the surface on which they appear a ridge extending across said disc approximately parallel to the pivotal axis of the disc; the concavities and ridge appearing on the opposite surface as convexities and a valley.

5 Claims, 3 Drawing Figures

DISPLAY ELEMENT

This invention relates to the construction of a display element.

The display element described herein will be used in electromagnetically operated displays. The type of display is shown generally in such patents as:

U.S. Pat. No. 3,140,553 dated July 14, 1964
U.S. Pat. No. 3,283,427 dated Nov. 8, 1966
U.S. Pat. No. 3,295,238 dated Jan. 3, 1967
U.S. Pat. No. 3,365,824 dated Jan. 30, 1968
U.S. Pat. No. 3,303,494 dated Feb. 7, 1967
U.S. Pat. No. 3,624,941 dated Dec. 7, 1971

These patents disclose the mounting and operation of display elements oppositely colored on opposite sides which are pivotably mounted, carry a magnet for rotation therewith extending traversely to the pivotal axis, and have their orientation controlled by the application of a magnetic field exterior to the element.

Although the device described above have utility with large and small display elements, the invention to be described is of more likely application where the display elements are of relatively large size, i.e. of 1¼ inch diameter or larger.

Such display elements have been made of thin non-magnetic materials, usually metal or plastic, generally, but not necessarily circular in shape and provided with a pair of ears on opposite sides extending in the same direction generally transverse to the plane of the disc and provided with means for the pivotal mounting of the disc, such means usually comprising apertures in the ears to receive a shaft threaded therethrough. A magnet mounted for rotation with the disc allows its control by an exterior field.

It has been found that such elements, particularly those of large size, have tended, in ambient light and heat, to differentially expand because the darker side absorbs heat at a faster rate than the lighter. With a flat disc, this has tended to warp the disc and, to the extent that such warpage has taken place about a bend line transverse to the pivotal axis; has, by interferring with or misaligning the pivotal mountings of the elements, tended to interfere with the free pivotting of the element on its pivotal axis.

In accord with this invention, the flat form of the disc (contrastingly coloured on opposite surfaces) is shaped to provide slight spaced depressions or concavities on one of the surfaces (resulting in complementary convercities on the other surface). The concavities on one surface define between them a raised ridge and also constitute the periphery of the disc as a raised portion relative to the depressions. The opposite surface of the disc is, of course, of complementary form with a valley extending across the disc corresponding to the ridge. The resultant shape of the disc which is like a shallow W, when viewed in cross-section and along the pivotal axis, acts to prevent warpage or distortion of the disc under differential expansion or stresses, particularly in directions (i.e. about bend lines having a component transverse to the pivotal axis) which would otherwise tend to deflect the pivotal mountings relative to each other. The shaping of the disc, as described, also acts to strengthen the disc against differential expansion in other directions and in general to strengthen the disc.

An alternative to the form shown may be provided where the disc, provided with ears and magents as shown, is not provided with the depressions discussed above but merely shaped to form a diametrically extending ridge extending approximately parallel to the intended axial direction. Although such disc with the ridge only is not as strong in all dimensions as the embodiment of FIGS. 1 and 2, channel effect provided by the ridge reduces bending of the disc about a line perpendicular to the shaft.

In drawings which illustrate a preferred embodiment of the invention:

Figure 1A:
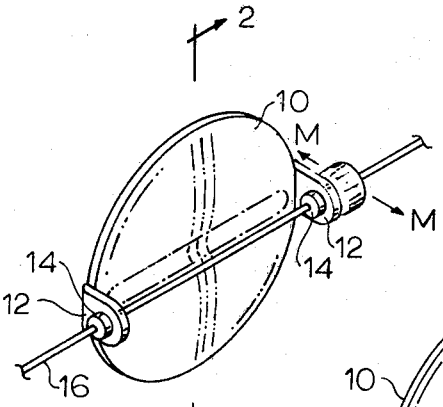
FIG. 1A shows an element pivotally mounted, on a shaft.

In the drawings, a metal disc is preferably made of aluminium and although the exact range of thickness is not critical, I prefer to use aluminium of 5/1000 of an inch in thickness. Magnesium or other non-magnetic metals in thin form may be also used. Plastic materials may also be used. The materials used should, however, be substantially non-magnetic, since magnetic material would otherwise tend to distort or nullify the effects of the rotating magnet mounted for rotation with the element.

With the metal disc 10 shown, pivotal mounting means are preferably provided in the form of ears 12 extending from the material of the disc and each bent to extend transversely from the disc in the same direction relative thereto and to provide opposed pivotal mountings 14 as shown, along an approximate centre line of the disc. The ears 14 are used to provide the pivotal mounting of the disc and are apertured so that a mounting shaft 16 may be threaded therethrough to rotatably mount the element.

Alternative pivotal mounting means are available and will be in some cases used particularly with discs formed of plastic. Such alternatives pivotal mountings are considered within the scope of the invention; and the criterion so far as the invention is concerned being that the pivotal mounting means defines an axis approximately parallel to a line extending approximately centrally across the disc.

The disc will mount a magnet 18 defining a magnetic axis M-M extending transverse to the rotational axis. The magnet may be mounted in various ways and the alternatives are considered within the scope of the invention. However, in the embodiment show, the magnet is attached to one of the ears 12 for rotation therewith is oriented to define a magnetic axis which is perpendicular to the pivotal axis and to the disc.

The disc 10 is oppositely coloured on opposite surfaces. It is preferred, for improved appearance of an array of such elements, to color more darkly the side on which the ears 12 extend, and the opposite side more brightly. In the interest of illustrating the structure of the device no indication of colour is given on the drawings. However, the darker side is usually a dull black while the brighter side may be such colours as white, red, orange, yellow or green and these may be of the fluorescent type. One of the surfaces of the disc (here the side opposite to the one on which the ears extend) is provided with a pair of concavities 19 which are located on each side of and define between them a raised portion or ridge 20 extending across the centre of the disc. Thus the concavities are each surrounded by the relatively raised centre line and the relatively raised periphery 21 of the disc. As illustrated in FIG.

1A the brighter side of the disc (the right side in FIG. 2) is thus provided with two convexities bordered by a centre line depression or valley (the complement of ridge 20) and a lowered periphery. Although the light and dark colouring together with the contouring of the faces could be reversed and still achieve the objects of the invention, the arrangement shown proved that the valley formed on one side of the disc faces the pivot axis and provides clearance for the pivot shaft.

The disc thus shaped, may be formed from aluminium and shaped in a single stamping and shaping operation or in two separate operations. In a disc of plastic, the shape might be imparted to the device in the molding operation.

However, the invention extends to the shape produced whatever the forming method used.

The shaping of the disc described provides strength therefor in all dimensions. Moreover, as will be noted in FIG. 2, viewed along the pivotal axis, the disc forms a flat W in centre cross-section. When the disc is subject to heat through convection or ambient radiation, the differential thermal expansion of the disc material will increase the sharpness of some and decrease the sharpness of others of the W folds. Thus differential expansion may increase the channel effect of one or another of the folds which folds provide rigidity in the disc against bending along lines having components transverse to the pivotal axis. Misalignment of the pivotal axis is thus avoided. It will be noted that this advantageous effect of the spaced concavities is of value even if the bearings are otherwise constructed than is shown on the preferred embodiment.

Figure 2:
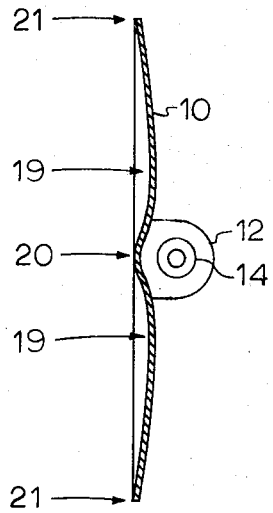
FIG. 2 shows a cross-section along the lines 2-2 of FIG. 1.

Moreover, the depressions 19 form a relatively raised edge 21 about the edge of the disc best shown in FIG. 2, which forms an additional reinforcing channel.

Figure 1B:
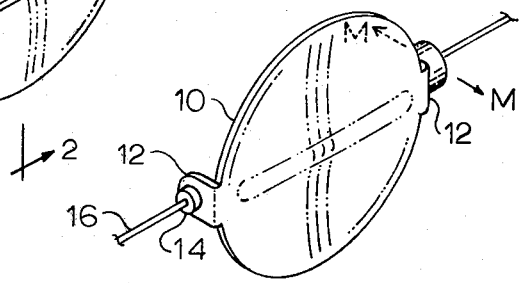
FIG. 1B shows the other side of the element of FIG. 1A.

Alternatively a simpler disc to that shown in FIGS. 1 and 2 having the ears and magnets as shown, formed without the depressions but to provide a diametrically extending ridge extending approximately parallel to the extended axial direction. Although such disc with the ridge only is not as strong in all dimensions as the embodiment of FIGS. 1 and 2, the channel effect provided by the ridge reduces bending of the disc about a line perpendicular to the shaft.

I claim:

1. A disc of substantially non-magnetic material, provided on opposite sides with ears extending transversely in the same direction relative to the disc, said ears being designed to allow the pivotal mounting of said disc on supporting means, said disc being contrastingly colored on opposite surfaces said disc being shaped so that two spaced concavities are provided as viewed on one of said surfaces, said concavities being on opposite sides of and defining on the surface on which they appear a ridge extending across said disc approximately parallel to the pivotal axis of the disc, said concavities and ridge appearing on the opposite surface as convexities and a valley.

2. A disc as claimed in claim 1 formed so that the side defining said valley faces the pivotal axis and said valley is located to provide clearance between said disc material and the shaft located on said pivotal axis.

3. A disc of thin substantially non-magnetic material, means for pivotally mounting said disc for rotation about a pivotal axis roughly parallel to a line across said disc approximately centred thereon, said disc being coloured contrastingly on opposite surfaces, said disc being shaped to form a pair of concavities on one of said surfaces, said concavities being on opposite sides of and defining a ridge extending across said disc approximately parallel to the rotational axis, whereby the opposite surface of said disc is shaped to provide convexities with a valley in between.

4. A disc as claimed in claim 3 wherein the disc is oriented and shaped so that such valley faces and provides clearance between the disc material and the pivotal axis.

5. A disc of substantially non-magnetic material, provided on opposite sides with ears extending transversely in the same direction relative to the disc, said ears being designed to allow the pivotal mounting of said disc on supporting means, said disc being contrastingly coloured on opposite surfaces, said disc being shaped to provide on one side a ridge, and on the other side a valley, extending across said disc approximately parallel to the pivotal axis of the disc.

* * * * *